United States Patent [19]

Hansen et al.

[11] 3,996,396

[45] Dec. 7, 1976

[54] METHOD FOR REPAIRING ROOFING

[76] Inventors: Howard C. Hansen, 926 E. Hermosa Drive, Tempe, Ariz. 85282; Norman L. Marsh, 818 W. Estes Way, Phoenix, Ariz. 85041

[22] Filed: May 27, 1975

[21] Appl. No.: 581,106

[52] U.S. Cl. ..... 427/140; 156/94; 156/98; 156/280; 156/305; 427/402; 427/413

[51] Int. Cl.[2] ..... B32B 35/00

[58] Field of Search ..... 427/140, 402, 407, 413; 156/94, 98, 280, 305; 428/141, 142; 264/36

[56] References Cited

UNITED STATES PATENTS

| | | | |
|---|---|---|---|
| 1,880,429 | 10/1932 | Ford | 156/94 |
| 3,215,243 | 11/1965 | Dickerson | 156/94 |
| 3,756,895 | 9/1973 | Bellamy | 156/94 X |

*Primary Examiner*—Thomas J. Herbert, Jr.
*Assistant Examiner*—Bruce H. Hess
*Attorney, Agent, or Firm*—Herbert E. Haynes, Jr.

[57] ABSTRACT

A method for repairing a roof comprising the steps of: spreading a porous conformable membrane over the existing roofing materials, moistening the membrane to cause it to conform to the roofing surface, tacking the membrane through the existing roofing materials and into the roofing substrate, applying a sealing adhesive to the membrane, and covering the membrane with a waterproof roof coating.

4 Claims, 4 Drawing Figures

METHOD FOR REPAIRING ROOFING

BACKGROUND OF THE INVENTION

1. Field of the Invention

This invention relates to roofing and more particularly to a method for repairing a roof.

2. Description of the Prior Art

The particular prior art procedure employed to correct the well known problems associated with the normal deterioration of conventional roofing materials, such as asbestos shingles, asphalt shingles, rolled roofing and the like, is determined by the amount of deterioration of that material.

In instances where the deterioration of such roofing materials is localized and of a relatively minor nature, simple patching of the problem area with tar or other suitable roof patching material will usually suffice. However, the need for employing such a patch is usually a signal which indicates that more drastic corrective measures will soon be needed.

When the deterioration of roofing materials progresses to a point where patching is no longer practical, either of two alternatives have heretofore been employed. The first of these prior art alternatives is to completely replace the deteriorated roofing materials with new materials. Such replacement is very expensive due to material and labor costs, and such expense is more than many people can afford or are willing to pay. The second of these prior art alternatives is to completely cover the deteriorated roofing materials with any of several commercially available roof coating products. Such roof coating products are generally formulated to waterproof the deteriorated materials and do little or nothing to enhance the structural strength of those materials.

Roofing materials such as asbestos shingles, asphalt shingles and rolled roofing tend to become very brittle with age and are easily damaged by wind, a person walking on the roof and the like.

Therefore, it may be seen that deteriorated roofing materials which are coated with roof coating products as described above, are subject to damage and leaks can reoccur with very little provocation.

Thus, the need exists for a new and improved method for repairing deteriorated roofing materials which overcomes some of the problem and shortcomings of the prior art.

SUMMARY OF THE INVENTION

In accordance with the present invention, a new and improved method for repairing roofing materials is disclosed herein, and the disclosed method includes the steps of: spreading a porous confirmable membrane over the existing roofing materials, moistening the membrane to cause it to conform to the irregularities of the roofing surface, tacking the membrane through the existing roofing materials to the roofing substrate, applying a penetrating sealing adhesive to the membrane, and covering the membrane with a suitable waterproof roof coating product.

It may now be seen that the steps of the method of the present invention results in a sealed laminated roof structure which is waterproof and is highly resistant to damage from the elements and the like.

Additional steps may be accomplished, along with the above described steps, to further enhance the appearance, structural strength and the ability to resist damage of a roof repaired in accordance with the method of the present invention. The first of such additional steps is the repairing of obviously damaged or severely deteriorated spots in the existing roofing materials prior to spreading of the membrane. Such repairing may take the form of replacing missing or broken shingles, patching holes and the like. The second of these additional steps is the application of metallic edging strips along the edge of the roof to secure the peripheral edges of the existing roofing materials thereto. Such a step prevents lifting of the roofing materials at the periphery thereof, such as could occur during a wind storm.

Accordingly, it is an object of the present invention to provide a new and improved method of repairing a roof structure.

Another object of the present invention is to provide a new and improved method of repairing a roof structure which renders that structure leakproof and substantially increases the structural strength of the roof.

Another object of the present invention is to provide a new and improved method of repairing a roof structure which results in that roof becoming highly resistant to damage and is aesthetically appealing.

Another object of the present invention is to provide a new and improved method of repairing a roof which employs a membrane spread over the existing roofing materials which is affixed to such materials and to the roofing substrate, and which is sealingly bonded to form a waterproof laminated roofing structure.

The foregoing and other objects of the present invention, as well as the invention itself, may be more fully understood from the following description when read in conjunction with the accompanying drawings.

DESCRIPTION OF THE PREFERRED EMBODIMENT

Figure 1:
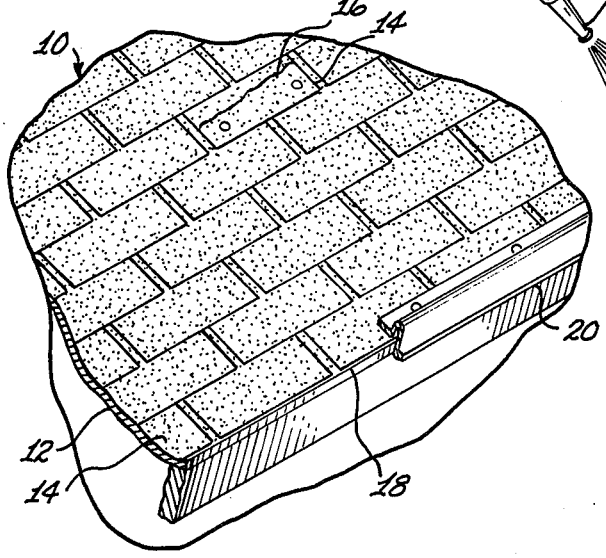
FIG. 1 is a fragmentary perspective view of a portion of a typical roof structure in which two of the steps of the method of the present invention are illustrated.

Referring more particularly to the drawings, FIG. 1 illustrates a fragmentary portion of a typical roofing structure which is indicated generally by the reference numeral 10. The roof 10 includes the usual roofing substrate 12 upon which roofing materials, such as the composition shingles 14, are affixed in accordance with well known techniques.

In accordance with the method of the present invention by which a roof structure is repaired, FIG. 1 illustrates two preliminary steps which may be accomplished. These first two steps are recommended but are not absolutely essential in accomplishing the objectives of the method of the present invention. The first of these optional preliminary steps is to repair obviously damaged or highly deteriorated portions of the existing roofing materials. Such a repair is shown at location 16 wherein a missing or broken shingle 14 has been replaced. Other types of such preliminary repairing should be accomplished at this same time such as the patching of holes and the like with conventional roof patching materials such as tar. The second of these optional steps is to secure the edges 18 of the shingles 14 to the roof substrate 12. Although such securing could be accomplished with nails, staples, or the like, the preferred method is to employ a conventional metallic roof edging strip 20. Such edging strips are well known in the art and, although not commonly used on a shingle roof, are in general usage on roofing structures when the roofing materials are of the rolled roofing type. As shown in FIG. 1, the strip 20 is nailed or otherwise secured along the edge of the roof 10 so that the peripheral edges of the roofing materials 14 are affixed thereto. It may now be seen that when this step is accomplished, undesired lifting of the peripheral edges of the roofing materials 14 cannot occur as the result of wind or the like.

The next step in the method of the present invention is to spread a porous conformable membrane 22 over the entire surface of the existing roofing materials 14. The membrane 22 must be made of a material which is porous so as to insure penetration of a sealing adhesive and roof coating material as will hereinafter be described in detail. The membrane material must also have the capability of being able to conform to the irregularities of the surface of the existing roofing materials to insure a contiguous contact therebetween. It should be noted that the type of material which serves as the membrane 22 must not have a "memory". That is, this material must not return to its original state once it has been made to conform to the irregularities of the roofing surface. Although many fabric materials will serve this purpose very well, it has been determined through experimentation that burlap is particularly well suited due to its conformability, porosity, and inherent structural strength. Another desirable feature of burlap is its relatively low cost.

Figure 2:
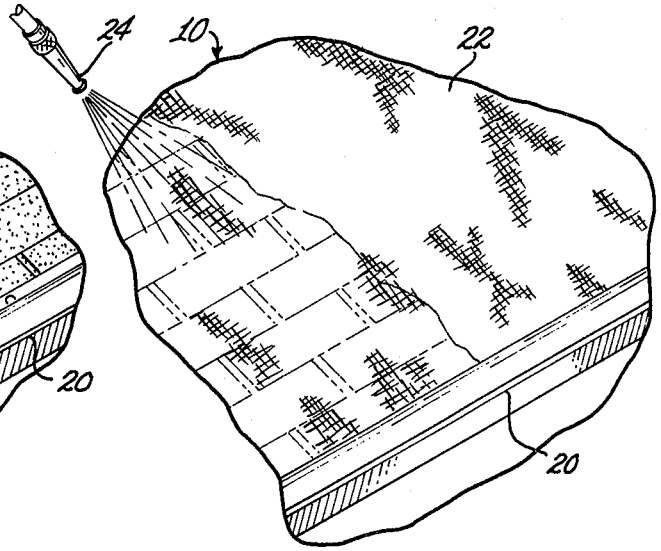
FIG. 2 is a view similar to FIG. 1 in which further steps of the method of the present invention are illustrated.

As seen in FIG. 2, the porous conformable membrane 22 is spread over the existing roofing materials 14 and is then ready for the next step of the present invention. This next step, also seen in FIG. 2, is moistening or otherwise shaping of the membrane 22 to bring it into contiguous conformity with the surface of the existing roofing materials. Any liquid will accomplish this purpose, and due to its economy, water such as from a garden hose 24 will suffice.

Figure 3:
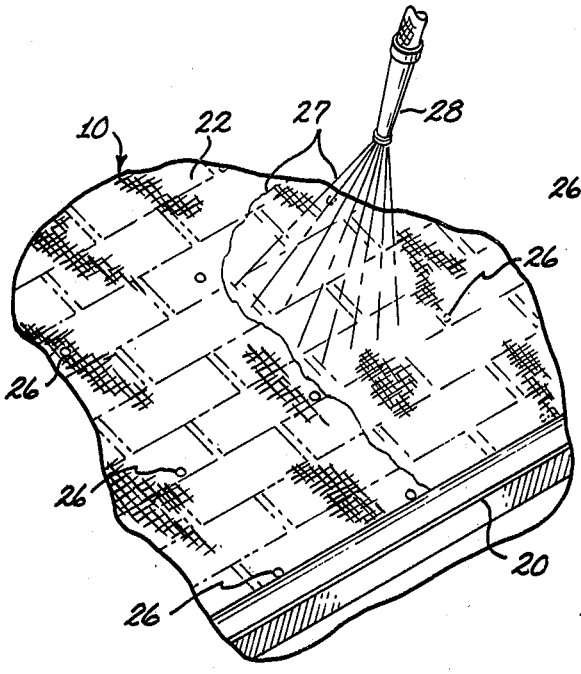
FIG. 3 is a view similar to FIG. 1 in which further steps of the method of the present invention are illustrated.

After the membrane 22 is made to contiguously conform with the roofing materials 14, the next step is to tack the membrane 22 through the roofing materials 14 and to the roof substrate 12. This tacking may be accomplished, as shown in FIG. 3, with any suitable mechanical fasteners 26 such as nails, staples or the like. The spacing intervals of such tacking is not critical but it is recommended that this mechanical fastening be accomplished at intervals of about 2 and 3 feet.

FIG. 3 also illustrates the next step of the method of the present invention, which is the application of a suitable sealing adhesive 27 which may be applied such as with a suitable spray nozzle 28. The objective of this sealing adhesive is to penetrate into the membrane 22 and into the existing roofing materials 14 to form a sealed bonded laminate thereof. These objectives may be accomplished with such well known products as a silicone rubber emulsion, asphaltic emulsion or the like. However, it is preferred that a special product be employed for this purpose which is marketed under the trade name Crystaloc by Modular Distributing, 913 South Hohokam, Tempe, Ariz., 85281. This preferred product is fully described in pending U.S. patent application, Ser. No. 508,769 filed Sept. 24, 1974, now abandoned.

Figure 4:
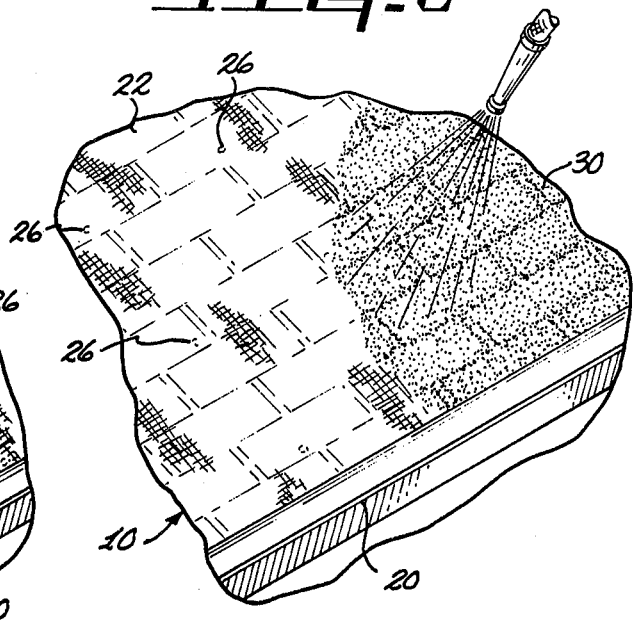
FIG. 4 is still another view similar to FIG. 1 which illustrates the final step of the method of the present invention.

The final step in the method of the present invention is the application of a suitable waterproof roof coating material indicated at 30 in FIG. 4, such as the product marketed under the tradename Monoflex by the company identified above. This roof coating product is fully disclosed in U.S. Pat. No. 3,827,894.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claim is:

1. A method of repairing a roof structure comprising the steps of:

a. spreading a porous conformable membrane over the existing roofing materials;

b. shaping said porous conformable membrane by moistening thereof with a liquid to provide a contiguous conformity thereof with the surface of the existing roofing materials;

c. tacking said porous conformable membrane through the existing roofing materials to the roofing substrate to mechanically affix said membrane and the existing roofing materials thereto;

d. applying a penetrating sealing adhesive to said porous conformable membrane to form a sealed bonded laminate of said membrane and the existing roofing materials; and e. applying a waterproof coating substance on said porous conformable membrane.

2. A method as claimed in claim 1 including the additional step of repairing damaged portions of the existing roofing materials prior to the step of spreading said porous conformable membrane thereon.

3. A method as claimed in claim 1 including the additional step of affixing the peripheral edges of the existing roofing materials to the edge of the roofing substrate.

4. A method as claimed in claim 1 including the additional step of affixing a metallic roof edging strip along the peripheral edges of the existing roofing materials for affixation thereof to the edges of the roofing substrate.

* * * * *